United States Patent [19]

Carrig et al.

[11] 4,253,402

[45] Mar. 3, 1981

[54] DESK TRAY AND METHOD OF MAKING THE SAME

[75] Inventors: Thomas R. Carrig; James T. Kraus, both of Wapakoneta, Ohio

[73] Assignee: Sheller-Globe Corporation, Toledo, Ohio

[21] Appl. No.: 3,603

[22] Filed: Jan. 15, 1979

[51] Int. Cl.[3] ..... A47B 17/00

[52] U.S. Cl. ..... 108/27; 211/126; D19/92; 248/188.9

[58] Field of Search ..... 248/615, 616, 635, 634, 248/188.9; 16/42; 211/126; 108/27

[56] References Cited

U.S. PATENT DOCUMENTS

| | | | |
|---|---|---|---|
| D. 188,832 | 9/1960 | Staebell | D19/92 |
| D. 240,820 | 8/1976 | Bell et al. | D19/92 |
| 1,355,486 | 10/1920 | Longenecker | 211/126 |
| 1,664,521 | 4/1928 | Mayette | 16/42 |
| 1,762,596 | 10/1928 | Soper | 211/126 |
| 1,830,058 | 11/1931 | Helmond | 248/615 |
| 1,957,153 | 5/1934 | Smiley | 211/126 |
| 2,349,385 | 5/1944 | Snelling | 211/126 |
| 2,456,929 | 12/1948 | Dee | 211/126 |
| 2,575,919 | 11/1951 | Kautzmann et al. | 211/126 |
| 2,858,028 | 10/1958 | Hunting et al. | 211/126 |
| 2,901,120 | 8/1959 | Abrahamson | 211/126 |
| 3,095,093 | 6/1963 | Pelak | 211/126 |
| 3,103,332 | 9/1963 | Waters | 248/188.9 X |
| 3,170,415 | 2/1965 | Suilokos | 108/27 |
| 3,477,674 | 11/1969 | Schaller | 248/615 |

FOREIGN PATENT DOCUMENTS

| | | | |
|---|---|---|---|
| 472412 | 8/1914 | France | 248/188.9 |
| 934482 | 8/1963 | United Kingdom | 248/615 |
| 1339204 | 11/1973 | United Kingdom | 248/615 |

*Primary Examiner*—Roy D. Frazier
*Assistant Examiner*—Peter A. Aschenbrenner
*Attorney, Agent, or Firm*—Wilson, Fraser, Barker & Clemens

[57] ABSTRACT

A desk tray structure including a base member with at least one upwardly extending side wall. A plurality of legs are attached to the extend from the bottom surface of the base member. The legs are secured to the bottom surface of the base in such a manner to assure that the document supporting surface does not contain any impediment to the smooth surface thereof.

Typically, the bottom portion of the legs are provided with means to prevent abrasion to the tray supporting surface.

Individual trays may be stacked together by utilizing spacer brackets which extend between the legs of the lowermost tray and corresponding legs of the next higher tray.

14 Claims, 6 Drawing Figures

DESK TRAY AND METHOD OF MAKING THE SAME

BACKGROUND OF THE INVENTION

1. Field of the Invention

The present invention relates to stackable desk trays and the method of making the same.

2. Description of the Prior Art

It has long been common practice to stack desk trays one upon the other to facilitate the arrangement of a plurality of trays to support various documents within the relatively confined area of a desk top.

U.S. Des. Pat. No. 188,832 is typical of stackable desk trays which are common in the marketplace. As shown in the patent, the tray includes elongate sleeves which receive posts to inter-connect one tray to the tray immediately above. Similarly, U.S. Pat. No. 2,901,120 shows a stackable tray arrangement having sleeve members attached to the side walls thereof to receive one end of respective spacer posts, the opposite ends of which are received in similar sleeves in the next adjacent tray.

U.S. Des. Pat. No. 240,820 shows a tray arrangement wherein a plurality of clips are positioned on the bottom of the tray and serve to receive the end portions of angled posts which extend from the base of one tray to the base of an adjacent tray. This arrangement provides means to interconnect and space adjacent trays and aids in supporting the trays assembly.

SUMMARY OF THE INVENTION

A number of problems are evident from the known tray structures and stacking arrangements. Among these problems is the cost of producing a complicated structure to hold the interconnecting spacer posts to the respective tray body. In many cases, the side walls of the trays must have sleeves either formed integrally of the tray structure, or added thereto after fabrication. Each such production step increases the cost of the final product. Also, the use of posts which have a complicated geometry or a number of bends and slots increases the cost of each unit and correspondingly reduces the commercial acceptability of the product.

The present invention overcomes these problems by using a minimum of parts of simple geometry to minimize the cost of fabrication. The desk tray structures of the present invention are independently useable, or may be joined together in stacked relation with simple spacer bracket members. Each individual tray includes a base member having an extended document supporting surface and at least one upwardly extending wall attached along a portion of the periphery of the base member. A plurality of legs are suitably attached to extend from the bottom surface of the base member without disturbing the upper document supporting surface of the base member.

When used singly, the trays are completed by placing foot pads over the legs. Typically, the foot pads enclose an insert which engages the legs to hold the pad thereon so the pad prevents abrasion to the underlying supporting surface.

To use the trays in a stacking arrangement, a leg is inserted through a slot in one arm of the spacer bracket and the foot pad is secured to the leg to maintain the bracket in place. The complimentary leg of an adjacent tray is inserted through the slot in an opposite arm of the spacer bracket and secured in place by a foot pad.

The process is continued until sufficient brackets are in place to securely hold the trays together.

It is an object of the present invention to produce a stackable tray arrangement which is fabricated from few parts, each of which are easily and inexpensively manufactured.

Another object of the present invention is to produce a desk tray arrangement consisting of two or more individual trays which may be assembled in stacked array by a person having minimal dexterity without the necessity of tools.

Still another object of the present invention is to produce a desk tray which can be efficiently manufactured and eliminates the need for sleeves or apertures in its structure to accept interconnecting posts.

BRIEF DESCRIPTION OF THE DRAWINGS

The above objects and advantages of the invention will become readily apparent to those skilled in the art from reading the following detailed description of a preferred embodiment of the invention, when considered in the light of the accompanying drawings, in which.

DETAILED DESCRIPTION OF THE INVENTION

Figure 1:
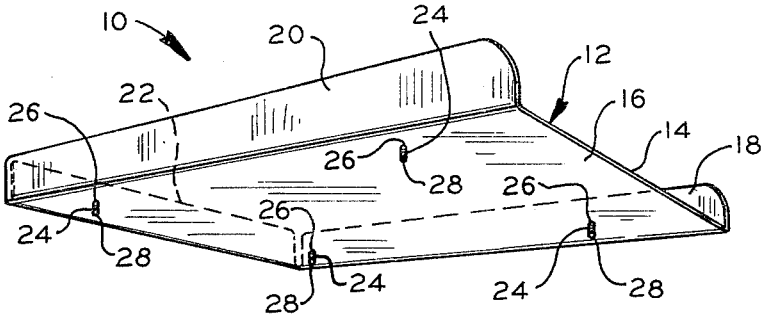
FIG. 1 is a perspective view of a tray structure embodying the features of the present invention.
Figure 2:
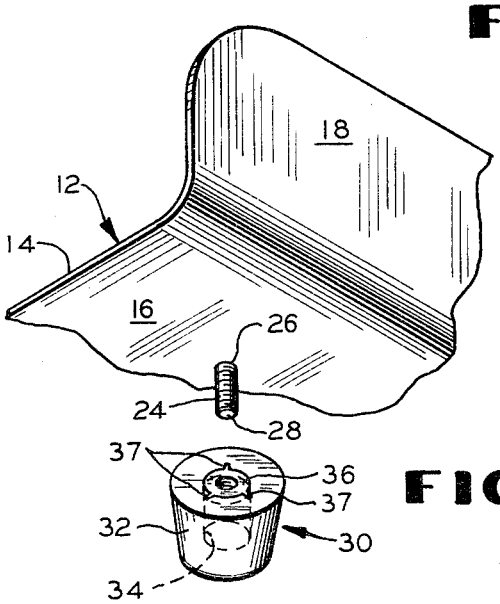
FIG. 2 is a fragmentary perspective exploded view showing a threaded leg and associated foot pad.
Figure 3:
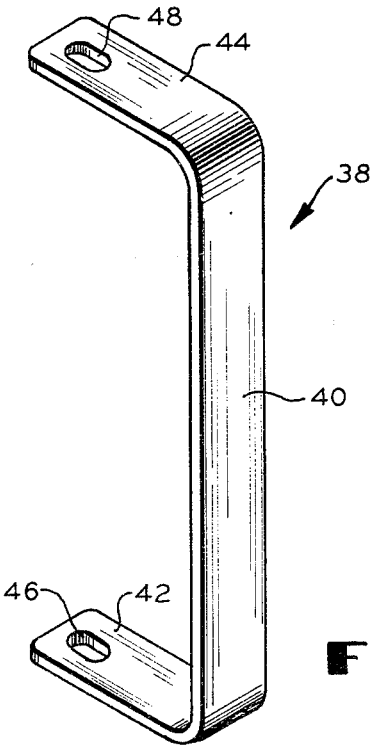
FIG. 3 is a perspective view of a spacer bracket.

Referring to FIGS. 1, 2, and 3, there is illustrated a tray structure, generally indicated by reference character 10, typically used on a desk or table top to store documents, such as, for example, invoices, correspondence, computer printout sheets, and the like. The tray structure 10 includes a base member, generally indicated by reference numeral 12, having a top document supporting surface 14 and a bottom surface 16. A pair of upwardly extending laterally spaced side walls, 18 and 20, are positioned along the marginal edge portion of the document supporting surface 14 of the base member 12. An upwardly extending rear wall 22 is positioned along the rear marginal edge of the base member 12.

A plurality of downwardly depending studs 24 are secured to the bottom surface 16 of the base member 12. The studs 24 have a first end portion 26 and a second end portion 28.

The first end portion 26 of each stud 24 is secured directly to the bottom surface 16 of the base member 12. The second end portion 28 of each stud 24 is adapted to be received within a structure which will prevent the stud 24 from marring an associated supporting surface.

In the preferred embodiment, the studs 24 are fabricated from an externally threaded metal stock. Similarly, the base member 12 and walls 18, 20 and 22 are fabricated from a single metal blank which is formed, preferably, by a stamping operation, into the desired shape. After the blank is formed, any sharp edges and corners of the base member 12 and walls 18, 20 and 22 are typically smoothed to prevent injury to the user by sharp edges or corners. In an actual embodiment, excellent results have been achieved by making the base member about 10.25 inches wide and 14 inches deep with the walls 18, 20, and 22 about 1.5 inches in height.

To secure the metal sutd 24 to the bottom surface 16 of the base member 12, the first end 26 of the stud 24 is fused to the bottom 16 of the base member 12 by a resistance welding technique by commercially available resistance welding apparatus.

A foot pad, generally indicated by reference numeral 30, is employed to receive the second end 28 of the stud 24 and prevent the stud 24 from marring the underlying surface of the associated support. The foot pad 30 is typically fabricated from an elastomeric material, such as rubber. In the preferred embodiment, the foot pad 30 is a generally cylindrical structure usually less than one inch in its longest axis and in its diameter. The foot pad 30 has a body portion 32 having a cavity 34, shown in phantom in FIG. 3, formed in one end thereof. An internally threaded insert 36 having radially extending fingers 37 is releasably seated within the upper portion of the cavity 34. The foot pad 30 is threadably secured to the second end 28 of the stud 24, thereby preventing the leg 24 from marring the underlying surface. The foot pad 30 may be rotated until the foot pad 30 abuts the bottom surface 16 of the base member 12.

In an alternative embodiment, the stud 24 may be fabricated from an unthreaded metal or plastic shaft and secured to the bottom surface of the base member. For a metalleg, resistance welding or metal fusion may be used, while for plastic any suitable adhesive may be employed. In the event it is desired to use an unthreaded stud, the associated insert would include a spring loaded clamp adapted to fit within a cavity in the foot pad and capable of holding the foot pad in secure engagement with the stud.

The use the tray structure 10 in a stacked array, a spacer bracket, generally indicated by reference character 38, is employed to space individual tray structures 10 apart. The spacer bracket 38, as clearly illustrated in FIG. 3, includes a main body portion 40 which has a pair of spaced apart, outwardly extending arms 42 and 44 integral therewith. Apertures 46 and 48 are formed near the end of each arm 42 and 44, respectively.

Figure 6:
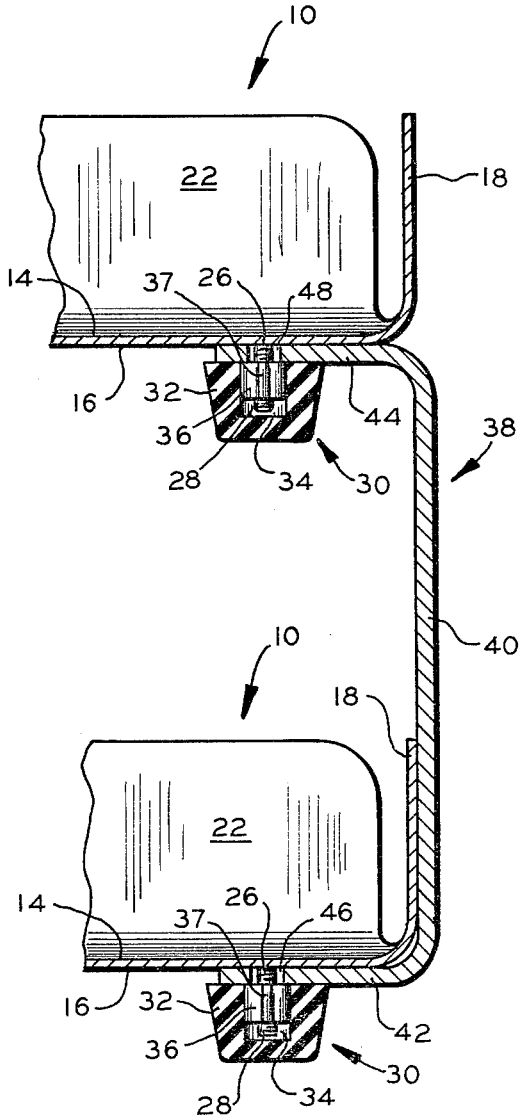
FIG. 6 is a fragmentary sectional view of the stacked array of tray structures illustrated in FIG. 5 taken along line 6–7 thereof.
Figure 4:
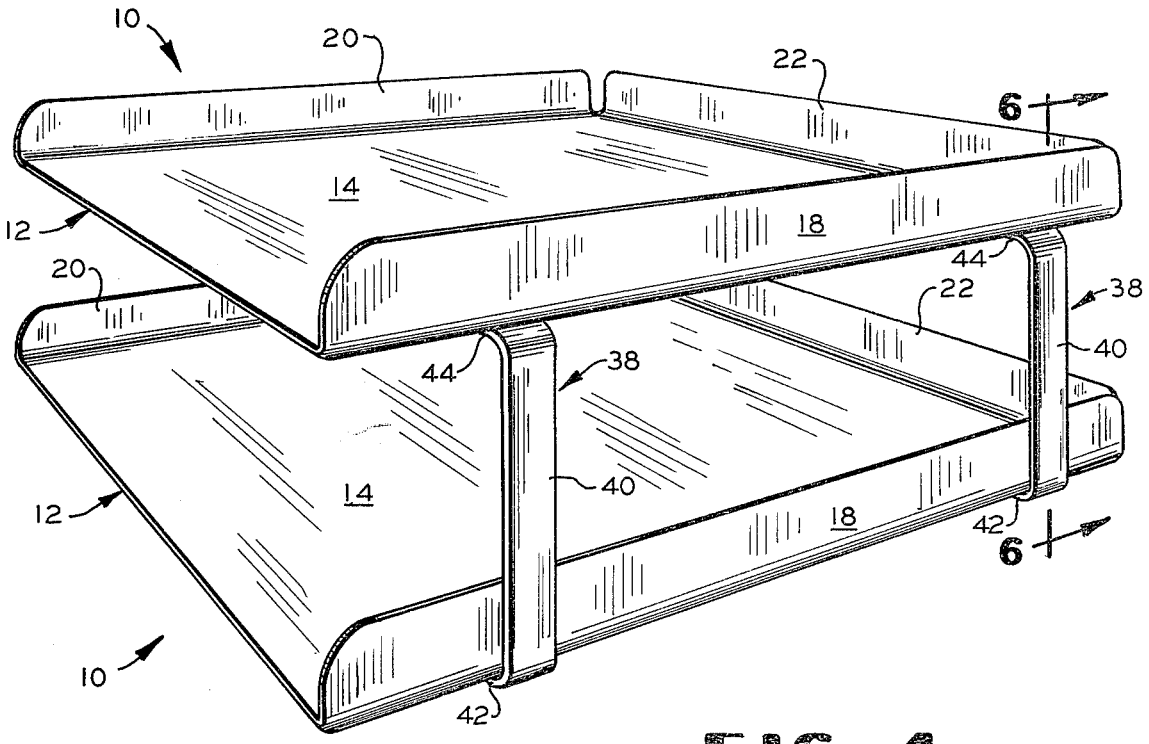
FIG. 4 is a perspective view of a stacked array of tray structures of the type illustrated in FIG. 1.
Figure 5:
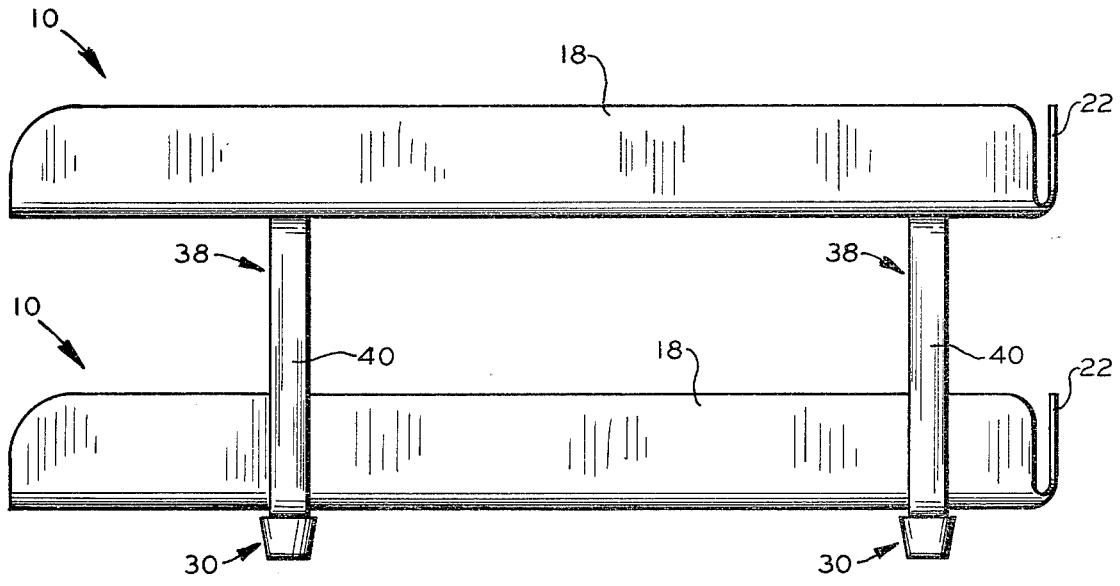
FIG. 5 is a side elevational view of the stacked array of tray structures illustrated in FIG. 4.

As shown in FIGS. 4, 5, and 6, individual tray structures 10 may be assembled in stacked relation. To accomplish the stacking relationship, the foot pads 30 are initially removed from the studs 24. Next, stud 24 is placed through an aperture 46 in one of the spacer brackets 38. The corresponding stud 24 of the next higher tray structure 10 is then inserted through the aperture 48 in the arm 44. The foot pads 30 are then snugly attached to the studs 24 to hold the spacer brackets in their proper orientation. Note that when the trays are used individually or in a stacked array, the document supporting surface 14 is free of obstructions. The back portion 40 of the spacer bracket 38 may be of any suitable length, for example, 4 inches. While two stacked tray structures 10 have been illustrated, any number of tray structures 10 may be positioned atop one another for a particular use.

As shown in FIGS. 4, 5, and 6, individual tray structures 10 may be assembled in stacked relation. To accomplish the stacking relationship, the foot pads 30 are initially removed from each of the depending studs 24. Next, a spacer bracket 38 is positioned such that one of the studs 24 is received within the aperture 46 formed in the lower arm of the bracket. Typically, a foot pad 30 is then threadably secured to the stud 24 to adequately secure the spacer bracket 38 to the lower tray structure 10. Then, the corresponding stud 24 of the next higher tray structure 10 is inserted through the aperture 48 in the upper arm 44 of the spacer bracket 38, and a foot pad 30 is then threadably attached to the stud 24 to secure the associated tray structure 10 in spaced relation from the lower one. This procedure is followed at each of the other three positions to adequately assure for a secured stacked relationship between the two adjacent tray structures. It has been found desirable, in many instances, to remove the body portions 32 of the foot pads 30 from the threaded inserts 36 associated with the uppermost trays. Manifestly, by removing the foot pads, during the stacked assembly, more room is provided between adjacent tray structures. Clearly, if the tray structures are then disassembled and utilized in their single unstacked form, the body portions 32 are reinserted over the threaded inserts 36 and their associated radially extended fingers 37.

It will be appreciated that when the tray structures 10 are used individually, or in a stacked array, the document supporting surfaces 14 are free of obstructions. It has been found that the spacer brackets 38 may be of any desired and suitable length, but it has been found that a four inch spacing between the lower and upper arms 42 and 44, respectively has been quite satisfactory.

While the illustrated embodiments of the invention show a stacked array of tray structures 10 of only two such structures, it will be apparent that any number of tray structures may be positioned atop one another depending on the particular use to which the array is to be applied.

In accordance with the provisions of the patent statutes, we have explained the principal and mode of operation of our invention, and have illustrated and described what is considered to be its best embodiment. It is to be understood, that within the scope of the appended claims, the invention may be practiced otherwise than as specifically illustrated and described.

We claim:

1. A desk tray structure comprising:

a first desk tray including a generally planar base section having an uninterrupted top document supporting surface and a coextensive bottom surface, at least one upwardly extending wall attached to the periphery of the document supporting surface of said base section, and a plurality of downwardly extending studs attached to the bottom surface of said base section in supporting relation therewith, said studs including resilient foot members;

a second desk tray including a generally planar base section having an uninterrupted top document supporting surface and a coextensive bottom surface, at least one upwardly extending wall attached to the periphery of the document supporting surface of said base section, and a plurality of downwardly extending studs attached to the bottom surface of said base section; and a plurality of spacer brackets for supporting said second desk tray above said first desk tray, said spacer brackets each including a generally vertical main body portion, a lower arm connected to the main body portion for engagement with one of said studs of said first desk tray, and an upper arm connected to the main body portion for engagement with one of said studs of said second desk tray whereby said second desk tray is positioned in supported relation above said first desk tray.

2. The invention defined in claim 1 wherein said foot members are releasably secured to said studs.

3. The invention defined in claim 1 wherein said extending studs include external threads.

4. The invention defined in claim 3 wherein said resilient foot members include internally threaded portions for receiving the external threads of said extending studs.

5. The invention defined in claim 4 wherein said resilient foot members are separable from the internally threaded portions.

6. The invention defined in claim 5 wherein said resilient foot members are provided with internal walled cavities containing the internally threaded portions.

7. The invention defined in claim 6 wherein the internally threaded portions of said foot members include radially extending fingers for snug engagement with the walls of said cavities.

8. The invention defined in claim 2 wherein said base sections and said studs are formed of metal.

9. The invention defined in claim 8 wherein said studs are fused to the bottom surfaces of said base sections.

10. A demountable desk tray assembly comprising, in pre-assembly configuration, at least two tray sections having a generally planar uninterrupted top document supporting surface, at least one wall disposed substantially normal to and extending from the periphery of said document supporting surface of each of said tray sections, a plurality of studs attached to a bottom surface of said tray sections, said studs including resilient foot members, a plurality of spacer brackets for supporting one of said tray sections above another one of said tray sections, said spacer brackets each including a generally elongate main body portion, a first arm extending substantially normal to said main body and including means for engagine one of said studs of one of said tray sections and a second arm extending substantially normal to said main body and including means for engaging one of said studs of another one of said tray sections, whereby said tray sections may be utilized individually and in multiply stacked configurations.

11. A demountable desk tray assembly comprising, in pre-assembly configuration, at least two tray sections having a generally planar uninterrupted top surface, a bottom surface, at least one wall disposed substantially normal to and extending from the periphery of said top surface of each of said tray sections, a plurality of studs secured to said bottom surface of said tray sections, a plurality of resilient foot members for securement to said studs, a plurality of spacer brackets for supporting one of said tray sections above another one of said tray sections, said spacer brackets each including a main body portion and first and second arm portions extending substantially normally from said main body portion, each of said arm portions including means for engaging one of said studs of one of said tray sections, whereby said tray sections may be utilized individually and in multiply stacked configurations.

12. A demountable desk tray assembly comprising, in pre-assembly configuration, at least two tray sections, each of said tray sections having a generally planar uninterrupted planar top surface, a bottom surface, a wall disposed, substantially normal to and continguous with at least a portion of the periphery of said top surface, and a plurality of studs secured to said bottom surface, said studs including resilient foot members, at least one spacer bracket for supporting one of said tray sections above another one of said tray sections, said spacer bracket including a main body portion and first and second arm portions extending substantially normally from said main body portion, said first arm portion including means for engaging at least one of said plurality of studs on one of said tray sections and said second arm portion including means for engaging at least one of said plurality of studs on another one of said tray sections whereby said tray sections may be utilized individually and in multiply stacked configurations.

13. The desk tray assembly of claim 10, 11, or 12 wherein said means for engaging said studs is an opening defined by said arm portion.

14. The desk tray assembly of claim 10, 11 or 12 wherein said studs and said foot members include complementary male and female threads, respectively.

* * * * *